US006536484B2

(12) United States Patent
Hewlitt et al.

(10) Patent No.: US 6,536,484 B2
(45) Date of Patent: Mar. 25, 2003

(54) CONTAINER AND A PROCESS FOR FILLING SAID CONTAINER

(75) Inventors: Timothy Hewlitt, London (GB); Steven Kelsey, London (GB); William Maskell, London (GB); Jerard O'Brien, London (GB)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/843,383

(22) Filed: Apr. 25, 2001

(65) Prior Publication Data

US 2002/0074053 A1 Jun. 20, 2002

(30) Foreign Application Priority Data

Apr. 25, 2000 (EP) ..... 00303442

(51) Int. Cl.[7] ..... B65B 1/04

(52) U.S. Cl. ..... 141/2; 141/18; 141/329; 347/86

(58) Field of Search ..... 141/2, 18, 301, 141/302, 98, 329, 330, 19; 347/84–87

(56) References Cited

U.S. PATENT DOCUMENTS

| | | | | |
|---|---|---|---|---|
| 3,167,210 A | | 1/1965 | Carney, Jr. | 220/63 |
| 3,802,470 A | | 4/1974 | Coleman | 141/10 |
| 3,966,091 A | | 6/1976 | Bencic | 222/129.1 |
| 4,006,841 A | | 2/1977 | Alticosalian | 222/42 |
| 4,077,182 A | | 3/1978 | Papaluca | 53/109 |
| 4,162,501 A | * | 7/1979 | Mitchell et al. | 101/366 |
| 4,330,066 A | | 5/1982 | Berliner | 215/1 C |
| 4,700,202 A | * | 10/1987 | Kuranishi et al. | 141/329 |
| 4,832,096 A | | 5/1989 | Kohlbach | 141/114 |
| 4,929,818 A | | 5/1990 | Bradbury et al. | 235/381 |
| 4,934,567 A | | 6/1990 | Vahjen et al. | 222/136 |
| 5,067,636 A | | 11/1991 | Pfeiffer et al. | 222/105 |
| 5,285,815 A | | 2/1994 | Henry et al. | 137/595 |
| 5,429,263 A | | 7/1995 | Haubenwallner | 220/404 |
| 5,474,111 A | | 12/1995 | Williamson et al. | 141/10 |
| 5,516,007 A | | 5/1996 | Larson | 222/105 |
| 5,685,435 A | | 11/1997 | Picioccio et al. | 209/677 |
| 5,758,571 A | | 6/1998 | Kateman et al. | 99/455 |
| 5,955,132 A | | 9/1999 | Spica et al. | 426/399 |
| 5,996,316 A | | 12/1999 | Kirschner | 53/443 |
| 5,996,824 A | | 12/1999 | Grant et al. | 215/2 |
| 5,997,236 A | | 12/1999 | Picioccio et al. | 414/403 |
| 6,058,984 A | | 5/2000 | Sato | 141/2 |
| 6,332,481 B1 | * | 12/2001 | Shinada et al. | 141/18 |

FOREIGN PATENT DOCUMENTS

| | | | |
|---|---|---|---|
| DE | 27 14 919 A1 | 10/1977 | B65D/43/02 |
| DE | 37 27 789 A1 | 3/1988 | B65D/47/20 |
| DE | 39 22 779 A1 | 1/1991 | B65B/3/04 |
| DE | 44 39 914 A1 | 5/1996 | B65D/23/08 |
| DE | 196 07 255 A1 | 8/1997 | B65B/3/00 |
| DE | 198 13 842 A1 | 9/1999 | B65G/47/49 |
| DE | 299 13 528 U1 | 1/2000 | G07F/17/18 |
| DE | 199 36 645 A1 | 4/2000 | B67D/5/34 |
| EP | 0 358 053 A2 | 3/1990 | B65D/77/06 |
| EP | 0 479 113 A1 | 4/1992 | B67D/1/00 |
| EP | 0 499 918 A2 | 8/1992 | E21D/11/00 |
| EP | 0501015 A1 | 9/1992 | B65D/77/06 |

(List continued on next page.)

*Primary Examiner*—Steven O. Douglas

(57) ABSTRACT

An enclosed container is provided comprising at least one first aperture, the first aperture(s) being provided with a first closure means and through which the contents of said container may be dispensed upon at least partial removal or opening of said first closure means, and at least one second aperture which is independent of at least one of said first aperture(s), the or each second aperture being provided with a second closure means and through which second aperture or apertures the container may be at least partially filled upon at least partial removal or opening of one or more of said second closure means. A process is also provided for filling a container which comprises positioning said container in a vending system which is provided with a dispensing means, in such an orientation and position that said dispensing means and said fill aperture are in engagement with one another.

12 Claims, 2 Drawing Sheets

FOREIGN PATENT DOCUMENTS

| | | | | |
|---|---|---|---|---|
| EP | 0 528 394 A1 | 2/1993 | ..... | B65D/77/06 |
| EP | 0 649 121 A2 | 4/1995 | ..... | G07F/17/16 |
| FR | 1 180 592 | 6/1959 | ..... | 20/4 |
| GB | 2188906 A | 10/1987 | ..... | B67D/5/56 |
| GB | 2244977 A | 12/1991 | ..... | B67D/5/56 |
| WO | WO 94/24010 | 10/1994 | ..... | B65D/25/00 |
| WO | WO 96/01227 | 1/1996 | ..... | B67D/5/56 |
| WO | WO 97/02898 | 1/1997 | ..... | B05B/7/28 |
| WO | WO 97/18538 | 5/1997 | ..... | G07F/13/08 |
| WO | WO 00/03944 | 1/2000 | ..... | B67D/1/08 |

* cited by examiner

CONTAINER AND A PROCESS FOR FILLING SAID CONTAINER

This application claims priority to the foreign application filed on Apr. 25, 2000, in Europe and having a serial number of 00303442.8.

FIELD OF THE INVENTION

The present invention relates to a container and a process for filling said container.

BACKGROUND OF THE INVENTION

It is common for containers designed to hold products of various types to be filled by machine. Typically, these machines are production line machines designed to achieve high speed filling and are operated by trained personnel. In this case, there is no requirement for specially designed fill points to the containers, and the common method is to fill through the container neck or dispense aperture.

It is also known for a vending system to fill containers at sites located in offices and workplaces. Typically, containers designed to work with these machines are also filled through the dispense aperture or the open mouth of the container.

Specialized containers for garden products are known in the art that have separate filling and dispense apertures, whereby the apertures are optimized for filling and dispense. However, these containers are not vended or filled by machine.

There also exists in the art a container for herbicides that requires two apertures for the metering and dispensing of product. This container is filled through one of the two apertures only in order to allow a rapid fill. The second aperture contains the metering chamber, which obstructs the fill path. Such products are not vended or dispensed at the point of sale, but are filled on the production line by trained personnel using specialised filling equipment.

A number of unique problems exist in situations where a product is to be dispensed by a vending system at the point of use or sale.

By "vending system" is meant a machine that dispenses product in response to one or more selections that are input into the machine by the user. Such a system may be operated by coin, token, card or other suitable means.

By "filling point" in the present invention, is meant the region of the vending system in which a container is placed for filling to occur.

By "filling head" in the present invention, is meant the nozzle of the vending system which dispenses the product.

In such cases, the user will be untrained in the art of dispensing and filling containers. For example, the user may not place the container in the correct position for filling and/or the user may not remove the closure, such as a cap that is present on the container, prior to commencing the filling process.

It is highly desirable to avoid such problems that may be associated with dispensing product using a vending system at the point of use or sale.

SUMMARY OF THE INVENTION

According to the present invention there is provided an enclosed container comprising at least one first aperture, the or each first aperture being provided with a first closure means and through which the contents of said container may be dispensed upon at least partial removal or opening of at least one said first closure means, and at least one second aperture which is or are independent of said first aperture or apertures, the or each second aperture being provided with a second closure means and through which second aperture or apertures the container may be at least partially filled upon at least partial removal or opening of one or more of said second closure means.

The present invention further provides a process for filling a container, which comprises positioning said container in a vending system which is provided with a dispensing means, in such an orientation and position that said dispensing means and said fill aperture are in engagement with one another.

By "independent" in the present invention, is meant that the first aperture is located at a position on the container which is apart from that of the second aperture.

It will be appreciated that within the scope of the present invention, "independent" is also intended to encompass a situation wherein the second aperture is located in the closure of the first aperture, that is to say whilst the second aperture shares a common path to the interior of the container, the first aperture cannot be considered identical to that of the second aperture.

Containers for the dispensing of products are well known in the art and are in widespread use.

Such containers are available in a wide variety of shapes and forms. They may be assembled from a wide variety of components, and may be manufactured from a wide variety of materials. Suitable materials include plastics materials, by way of example, Polyethylene Terephthalate (PET), Polypropylene (PP), Polyethylene (PE), High Density Polyethylene (HDPE), Polyvinyl Chloride (PVC) and barrier laminates such as PET/NYLON/PET and PP/BAREX®/PP etc. (BAREX® is a trade mark of BP Amoco plc), wood, metals such as aluminum, iron, and copper, metal alloys, ceramics and glass.

In one embodiment of the present invention, said container may be manufactured from a plastics material. As such, said container may be manufactured by any conventional process for the forming of plastics material.

In a preferred embodiment of the present invention, said container may be manufactured by an extrusion or injection blow-moulding process.

The container may include any dispensing, dosing or application feature or device providing the means to dispense the product in a wide variety of ways.

The container may include provision for manual or powered dispensing.

The container may be of any scale or size that is relevant to the product or the product use.

The container may comprise any number, combination and orientation of first and/or second apertures that meet the needs of the product, its intended use or its method of use.

The nature of the first aperture closure means is not limited and may be of any kind commonly used in the art.

In one embodiment of the present invention, the second aperture is located in the closure means of the first aperture. As such, the container design may be simplified, in that the container requires only a single aperture. For example, a reed valve may be conveniently located in the closure means of the first aperture.

The container may include any device or mechanism for filling.

Use of an independent second aperture allows filling to occur with or without the first aperture closure means being in place.

The nature of the second aperture closure means is not limited in the present invention, and may be of any kind commonly used in the art, provided that said second aperture closure means can open and re-close by some function of the filling process, by the action of the vending system or mechanism thereof, or by the inherent nature of the fill aperture.

In one embodiment of the present invention, the independent second aperture closure means may comprise a cap component with a central cover as a second component; said cover being attached to the cap wall by means of a flexible member, arranged such that the central cover can be depressed by the action of inserting into the vending system such that the cover moves away from the sealing surface thereby opening the cap. Once filled, the container is removed from the system allowing the cover component to return to its closed state.

In a further embodiment of the present invention, the second aperture closure means comprises a moulded ring forming an open tube attached to the container such that the tube communicates with the container interior; said ring being closed by a cover, which effects a seal by means of a mechanical interference; said cover being attached to the ring by a hinging member such that the cover can hinge open; and said cover having one or more protruding members arranged horizontally and/or vertically such that when the container is placed in the filling point of the vending system, said protruding members are acted upon by one or more elements such as bars or shaped members (which may be components of the vending system, in particular components of the filling point, the filling head, the positioning guides between the container and the filling point, or some other component of the filling point that may be designed to move into position to communicate with the cover protrusions) in order to open the cover.

Upon filling and removal from the vending system, the protruding members are acted upon by said elements, or additional and supplementary components, in order to close the cover.

In a further embodiment of the present invention, the second aperture closure means comprises a moulded ring forming an open tube attached to the container such that the tube communicates with the container interior; said ring being closed by a cover, which effects a seal by means of a mechanical interference; said cover being attached to the ring by a sliding fit such that the cover can slide open; and said cover having one or more protruding members arranged horizontally and/or vertically such that when the container is placed into the filling point of the vending system, said protruding members slide the cover away from the moulded ring, thereby allowing the container to be filled.

The cover is subsequently closed by action of the same or additional and supplementary components during the action of removal of the container from the filling point.

In a further embodiment, the second aperture closure means may consist of cap components as described in the previous embodiments, whereby the action of opening the cap closure is effected by a driven mechanism such as a moving cam, a rotating collar or a gripping mechanism, arranged such that the closure is acted upon by these or additional devices after the container is placed in position and is stationary rather than moving.

In a further embodiment, the second aperture closure means may comprise a moulded thermoplastic ring designed to communicate with the container interior; a second component consisting of a diaphragm made from a thin film or flexible material; said second component being attached to the underside of the first component at one or more points such that an intermittent circumferential seal is produced.

If made from a material of appropriate elasticity, the diaphragm may be locally deformed by the action of a liquid on the diaphragm surface such that the liquid can pass through the open or unsealed portions of the circumferential seal, thereby allowing the container to be filled.

In a further embodiment of the present invention, the second aperture closure means consists of a closure as defined in the previous embodiment, whereby the diaphragm material is pleated or folded in a linear or circular array such that on sealing to the moulded thermoplastic ring, only the surfaces of the diaphragm material in contact with the moulded component are sealed to its surface. This provides an alternative method to achieve an intermittent seal.

Using this method when filling under a nominal pressure, including the effect of gravity, the action of the liquid opens the pleated diaphragm to allow the liquid to pass into the container.

In such an embodiment, the diaphragm material may have a very low or zero elasticity.

In a preferred embodiment of the present invention, the second aperture closure means may comprise a reed valve. Reed valves are known in the art and are typically employed in footballs, wherein the football is filled with air via such a needle valve.

The location of the independent second aperture is not limited in the present invention, however in a preferred embodiment of the present invention, the independent second aperture will be centrally located on the container.

By "centrally located" in the present specification is meant, that the location of the independent second aperture or apertures provides a symmetry thereby allowing the container to be filled independent of the orientation of the container around a vertical axis when placed in the vending system.

It will be appreciated by one skilled in the art, that the number of possible orientations of the container when placed in the vending system may be fully or partially restricted by the container dimensions, and other features of the vending system and/or container.

It will be appreciated that the process according to the present invention may be applied to both liquids and solids, depending upon the precise nature of the independent second aperture and its closure means.

Containers according to the present invention may be conveniently used to store and transport a wide variety of materials such as foodstuffs, beverages, household products such as detergents, and automotive products such as lubricants.

BRIEF DESCRIPTION OF THE DRAWINGS

The present invention will now be described by way of example with reference to the accompanying drawings. It is to be noted, however, that the accompanying drawings illustrate only some embodiments of the invention and are therefore not to be considered limiting of its scope, because the invention may admit to other equally effective embodiments.

The present invention will now be described by way of example, with reference to the accompanying drawings, in which.

DETAILED DESCRIPTION OF THE INVENTION

Figure 1:
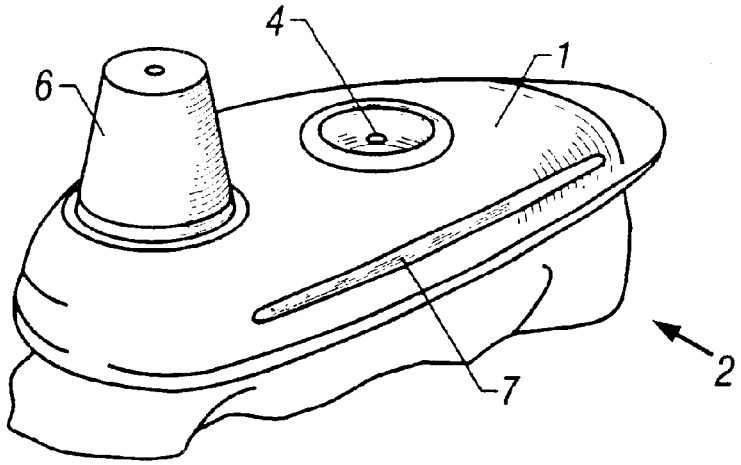
FIG. 1 is a perspective view of an upper portion of a container comprising independent first and second apertures, wherein the handle of said container is omitted for clarity.
Figure 2:
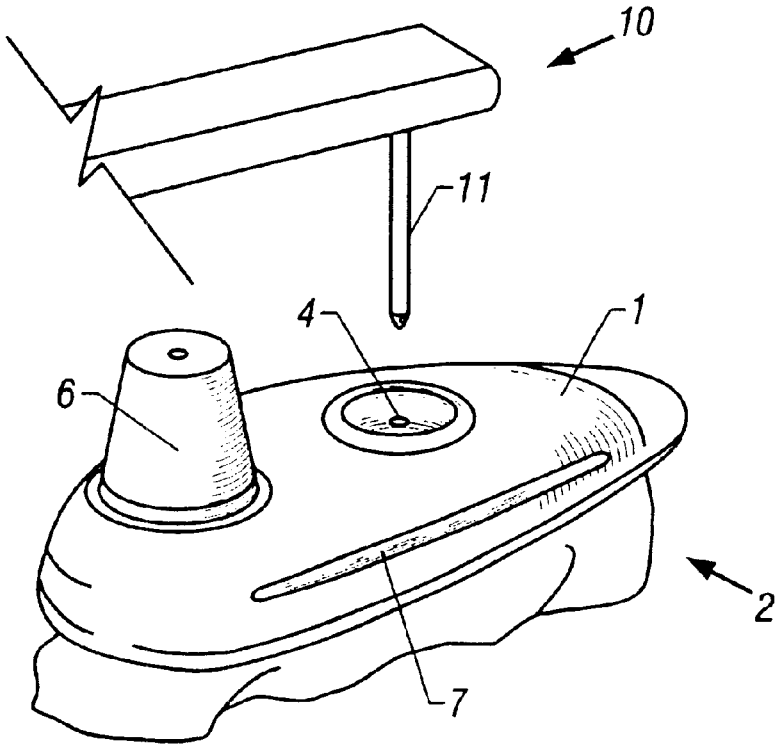
FIG. 2 is a perspective view of said upper portion together with a portion of a vending system filling head, wherein the handle of said container is omitted for clarity.

FIGS. 1–4 have similar elements that are similarly numbered and will be described in conjunction with each other.

An upper portion 1 of a container 2 is provided with a dispense aperture 3 and a fill aperture 4, which are remotely spaced from one another. Said fill aperture 4 is centrally located in said upper portion 1.

The dispense aperture 3 is provided with a drip trap 5 and a closure means in the form of a removable cap 6.

Furthermore, said upper portion 1 is provided with positioning grooves 7 (only one of which is shown) which, upon insertion of said container 2 into a vending system 8, engage with corresponding protrusions (not shown) in said vending system 8, to ensure correct positioning of said container 2 in said vending system 8. Such engagement of said positioning grooves 7 and corresponding protrusions may also serve to retain said container 2 in said vending system 8 during a filling operation.

Said upper portion further comprises a flexible carrying handle 9.

When said container 2 is positioned in said vending system 8, said fill aperture 4 is so positioned in relation to a vending system filling head 10, such that a needle valve 11 thereof is aligned with said fill aperture 4. By appropriate relative movement between said needle valve 11 and said fill aperture 4, said needle valve 11 will enter said fill aperture 4, which is provided with a closure means in the form of a reed valve 12.

Figure 3:
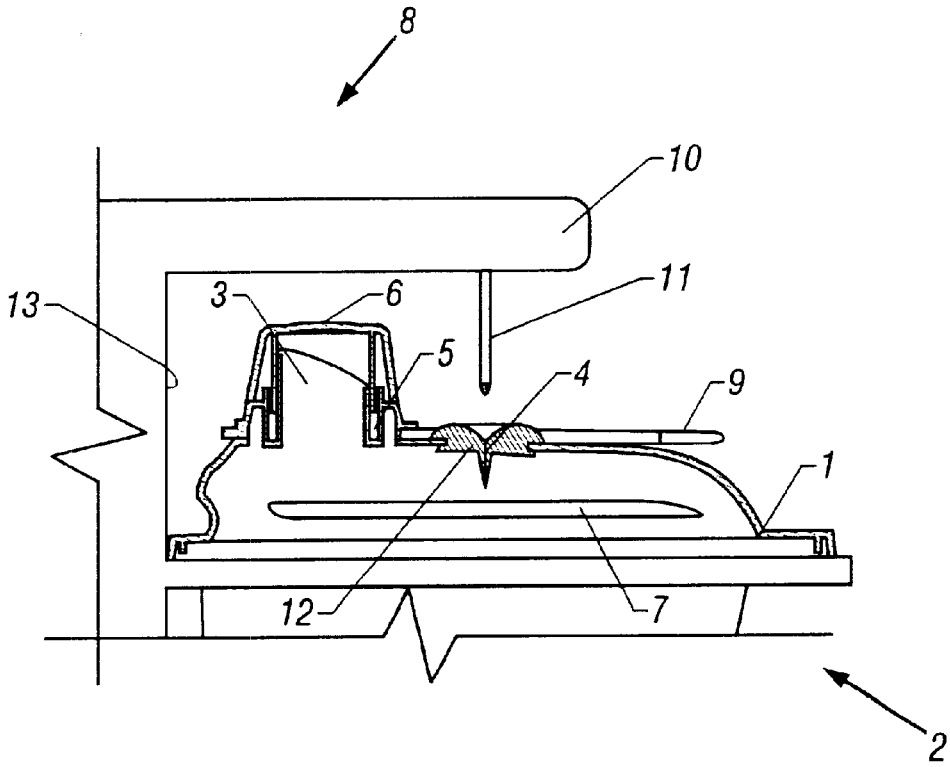
FIG. 3 is a cross-section through said upper portion of a container when positioned in a vending system having said filling head.
Figure 4:
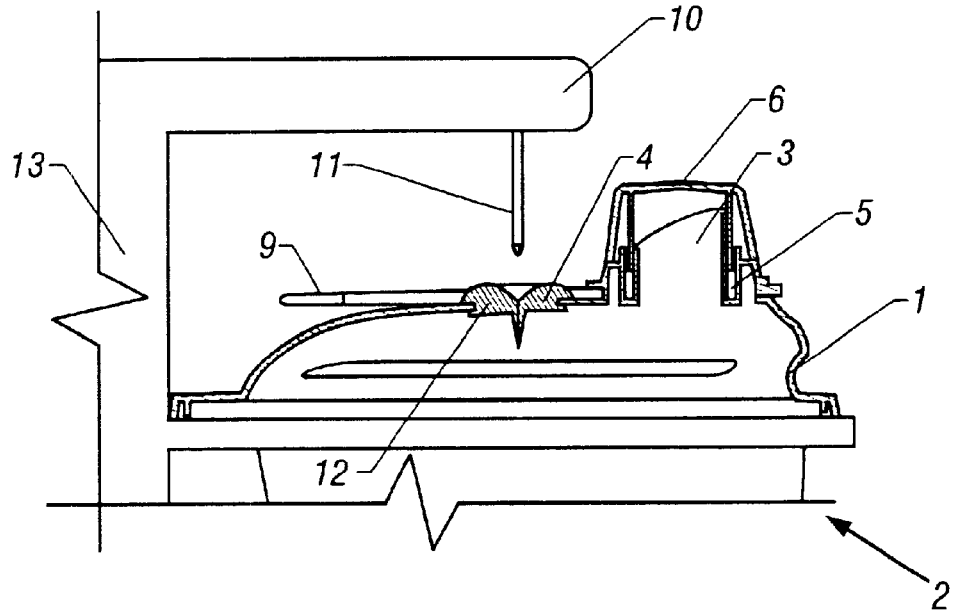
FIG. 4 is a cross-section similar to that in FIG. 3 but with said container having been rotated 180° about a vertical axis in relation thereto.

As can be seen from FIGS. 3 and 4, said container 2 can be positioned in said vending system 8, either with said dispense aperture 3 orientated toward a back wall 13 of the vending system, or orientated away from said back wall 13.

It will be appreciated that in both of the orientations depicted in FIGS. 3 and 4, said reed valve 12 of said fill aperture 4 is situated in the correct position for insertion by said needle valve 11 of said vending system 8.

While the foregoing is directed to various embodiments of the present invention, other and further embodiments may be devised without departing from the basic scope thereof. For example, the various methods and embodiments of the invention can be included in combination with each other to produce variations of the disclosed methods and embodiments. Also, the directions such as "top," "bottom," "left," "right," "upper," "lower," and other directions and orientations are described herein for clarity in reference to the figures and are not to be limiting of the actual device or system or use of the device or system. The device or system may be used in a number of directions and orientations. Further, the order of steps can occur in a variety of sequences unless otherwise specifically limited. The various steps described herein can be combined with other steps, interlineated with the stated steps, and/or split into multiple steps.

What is claimed is:

1. An enclosed container comprising at least one first aperture, said first aperture being provided with a first closure means and through which contents of said container may be dispensed, and at least one second aperture that is independent of said first aperture and through which said container may be at least partially filled, wherein said second aperture has a closure comprising a cap component with a central cover, said cover being attached to a wall of said cap component by means of a flexible member, arranged such that said central cover can be depressed by inserting into a vending system such that said cover moves away from a sealing surface on said cap component thereby opening said cap component.

2. The container according to claim 1, wherein said second aperture is centrally located in a surface of said container.

3. The container according to claim 1, wherein said first aperture and said second aperture are spaced from one another along a surface of said container.

4. The container according to claim 2, wherein said first aperture and said second aperture are spaced from one another along a surface of said container.

5. An enclosed container comprising at least one first aperture, said first aperture being provided with a first closure means and through which contents of said container may be dispensed, and at least one second aperture that is independent of said first aperture and through which said container may be at least partially filled, wherein said second aperture has a closure comprising a moulded ring forming an open tube attached to said container such that said tube communicates with an interior of said container; said ring being closed by a cover, which effects a seal by means of a mechanical interference; said cover being attached to said ring by a hinging member such that said cover can hinge open; and said cover having at least one protruding member arranged such that when said container is placed in a vending system, said protruding member is acted upon to open said cover.

6. The container according to claim 5, wherein said second aperture is centrally located in a surface of said container.

7. The container according to claim 5, wherein said first aperture and said second aperture are spaced from one another along a surface of said container.

8. The container according to claim 6, wherein said first aperture and said second aperture are spaced from one another along a surface of said container.

9. An enclosed container comprising at least one first aperture, said first aperture being provided with a first closure means and through which contents of said container may be dispensed, and at least one second aperture that is independent of said first aperture and through which said container may be at least partially filled, wherein said second aperture has a closure comprising a moulded ring forming an open tube attached to said container such that said tube communicates with an interior of said container; said ring being closed by a cover, which effects a seal by means of a mechanical interference; said cover being attached to said ring by a sliding fit such that said cover can slide open; and said cover having at least one protruding member arranged such that when said container is placed into a filling point, said protruding member slides said cover away from said moulded ring, thereby allowing said container to be filled.

10. The container according to claim 9, wherein said second aperture is centrally located in a surface of said container.

11. An enclosed container comprising at least one first aperture, said first aperture being provided with a first closure means and through which contents of said container may be dispensed, and at least one second aperture that is independent of said first aperture and through which said container may be at least partially filled, wherein said second aperture has a closure comprising a moulded thermoplastic ring designed to communicate with an interior of said container and a diaphragm made from a flexible material; said diaphragm being attached to an underside of said ring such that an intermittent circumferential seal is produced.

12. The container according to claim 11, wherein said second aperture is centrally located in a surface of said container.

* * * * *